US010651000B2

(12) United States Patent
Liu et al.

(10) Patent No.: US 10,651,000 B2
(45) Date of Patent: May 12, 2020

(54) METHOD FOR PREPARING PRESSED SCANDIA-DOPED DISPENSER CATHODES USING MICROWAVE SINTERING

(71) Applicant: Beijing University of Technology, Beijing (CN)

(72) Inventors: Wei Liu, Beijing (CN); Mingchaung Tian, Beijing (CN); Jinshu Wang, Beijing (CN); Fan Zhou, Beijing (CN); Yiman Wang, Beijing (CN); Liran Dong, Beijing (CN); Yunfei Yang, Beijing (CN); Quan Zhang, Beijing (CN)

(73) Assignee: Beijing University of Technology, Beijing (CN)

( * ) Notice: Subject to any disclaimer, the term of this patent is extended or adjusted under 35 U.S.C. 154(b) by 272 days.

(21) Appl. No.: 15/409,888

(22) Filed: Jan. 19, 2017

(65) Prior Publication Data

US 2017/0345608 A1 Nov. 30, 2017

(30) Foreign Application Priority Data

May 27, 2016 (CN) ..... 2016 1 0366220

(51) Int. Cl.
*B22F 3/105* (2006.01)
*H01J 9/04* (2006.01)
(Continued)

(52) U.S. Cl.
CPC ..... *H01J 9/04* (2013.01); *B22F 3/105* (2013.01); *B22F 9/026* (2013.01); *B22F 9/22* (2013.01);
(Continued)

(58) Field of Classification Search
CPC ..... B22F 2301/45; B22F 2302/25; B22F 2998/10; C22B 34/36; C22B 59/00
See application file for complete search history.

(56) References Cited

U.S. PATENT DOCUMENTS 4,625,142 A * 11/1986 van Esdonk ..... H01J 9/04 313/346 DC
5,407,633 A * 4/1995 Hasker ..... B22F 9/04 419/19
(Continued)

FOREIGN PATENT DOCUMENTS

CN 101628336 A * 1/2010

*Primary Examiner* — Vanessa T. Luk
(74) *Attorney, Agent, or Firm* — Zhihua Han

(57) ABSTRACT

The present disclosure discloses a preparation method of pressed Scandia-doped dispenser cathode using microwave sintering. Embodiments of the present disclosure include dissolving some nitrates and ammonium metatungstate with deionized water to prepare a homogeneous solution. Precursor powder with uniform size is obtained by spray drying, the precursor powder is decomposed, and two-step reduction may be proceeded to form doped tungsten powder with uniform element distribution. The cathode is prepared by one-time microwave sintering. One-time forming of cathode sintering is realized, and sintering shrinkage and sintering time are reduced significantly. The method has excellent repeatability, and the cathode has a homogeneous structure and excellent emission performance at 950° C.

6 Claims, 6 Drawing Sheets

(51) Int. Cl.

| | |
|---|---|
| ***B22F 9/02*** | (2006.01) |
| ***B22F 9/22*** | (2006.01) |
| ***C22B 34/36*** | (2006.01) |
| ***B22F 9/30*** | (2006.01) |
| *H01J 1/28* | (2006.01) |
| *H01J 19/22* | (2006.01) |
| *H01J 35/06* | (2006.01) |

(52) U.S. Cl.
CPC ..... *B22F 9/30* (2013.01); *C22B 34/36* (2013.01); *B22F 2003/1054* (2013.01); *B22F 2998/10* (2013.01); *H01J 1/28* (2013.01); *H01J 19/22* (2013.01); *H01J 35/06* (2013.01)

(56) References Cited

U.S. PATENT DOCUMENTS

| | | | | |
|---|---|---|---|---|
| 7,722,804 | B2 * | 5/2010 | Wang | C01G 41/006 313/346 DC |
| 2008/0025864 | A1 * | 1/2008 | Wang | C01G 41/006 419/19 |

* cited by examiner

C
Ba
Ba
Ba

METHOD FOR PREPARING PRESSED SCANDIA-DOPED DISPENSER CATHODES USING MICROWAVE SINTERING

CROSS REFERENCE TO RELATED APPLICATION

This application claims the priority benefit of Chinese Patent Application No. 201610366220.5, filed on May 27, 2016, titled "Method for preparing pressed scandia-doped dispenser cathodes using microwave sintering," which is hereby incorporated by reference in its entirety.

TECHNICAL FIELD

The present disclosure belongs to the area of insoluble rare-earth metal cathode materials and a tungsten matrix composite and more particularly to a method for preparing pressed scandia-doped dispenser cathodes using microwave sintering.

BACKGROUND

Recently, micro-focus X-Ray (micro-focus:<100 um×100 um) is developed quickly in medical treatment, health and aerospace areas. The research and development of X-Ray devices with small focus and high power arouses researchers' attention from different technical areas. The key technology of micro-focus X-Ray application is a source of micro-focus X-Ray: cathode of micro-area X-Ray tube. However, with the fast improvement of resolution and power of tube electron, the needs of small size and high power cathode become urgent, and the research and development of cathodes with high dimensional accuracy and high current emission is more and more important.

Scandia-doped dispenser cathode is the highest emission cathode. However, the preparation of this kind of cathode is complicated since secondary deformation is caused by molten salt, the sintering process can't be finished on one time. It has poor repeatability and is not satisfied with the desirable cathode requirement of micro-area X-Ray tubes. The formation of pressed Scandia-doped dispenser cathode can be finished on one time, but active materials distribute heterogeneous, resulting in poor structure homogeneity. Further, high emission performance can't be reached. In normal cathode sintering, the heating rate of the traditional sintering furnace is 5-10° C./min, and it takes 350-400 min to finish the whole process. Thus, under conventional methods, a lot of energy is wasted and, a long cooling time of sintering process leads to grain growth while repeatability is poor.

Microwave sintering is a new sintering technology with immediacy such that materials are heated as long as there has a microwave radiation. When microwave radiation is stopped, a heating process is stopped immediately. Thus, the fast heating can be realized, and energy transforming rate of the microwave is high, and heating rate can be reached in 40-50° C./min and easier to reach 1600° C. Since the heating and cooling process is fast, ultrafine grain materials are obtained. Under microwave sintering, grain growth is restrained, the microstructure of materials is improved significantly, the mechanical property of fine grain is excellent, and the contraction ratio of microwave sintering is reduced significantly compare with normal sintering. Further, the vertical shrinkage and horizontal shrinkage of this sample are only one third as much as normal sintering samples.

In conclusion, there is a need for finding an energy saving and one-time forming sintering method with fast heating and cooling rate to obtain a cathode with homogeneous structure and fine grain size. It is meaningful for improving the performance of micro-focus X-Ray and developing of terahertz vacuum electronic devices.

SUMMARY

Current technologies can't satisfy the development of micro-focus X-Ray and have some drawbacks, such as complicated preparation technique, low dimensional accuracy and the sintering process caused energy waste. The present disclosure discloses a preparation method of pressed Scandia-doped dispenser cathode by microwave sintering, one-time forming of cathode sintering is realized, and sintering shrinkage and sintering time are reduced significantly. Embodiments of the present disclosure have good repeatability with homogeneous structure and have excellent emission performance at 950° C.

To realize the goals mentioned above, technique schema used in the present disclosure includes the following steps:

A: preparation of precursor powder: dissolving ammonium metatungstate hydrate, scandium nitrate, aluminum nitrate, barium nitrate and calcium nitrate in water under room temperature, respectively, mixing ammonium metatungstate hydrate and scandium nitrate solution, and adding nitrate solution mentioned above slowly with constant agitation. In these instances, the concentration of the mixed solution is 40-80 g/L, precursor powder is obtained by spray-drying, feeding rate is 200 ml/h-600 ml/l, blast rate is 0.4 $m^3$/min-0.6 $m^3$/min and inlet temperature is: 150° C., the outlet temperature is 90-96° C.

B: decomposition and reduction of precursor powder: precursor powder is decomposed in muffle furnace, C and N contains in precursor powder is removed under the conditions of 550° C., air atmosphere (or oxygen atmosphere) and maintain 3 hours, oxide powder contains scandium oxide, and tungsten oxide is obtained; proceeding reduction process of the oxide powder in tube furnace under hydrogen atmosphere, which includes two steps, first, maintaining the temperature at 450-550° C. maintain 2-3 h, then, raising the temperature to 800-850° C. and maintaining 2-3 h to obtain doped tungsten powder.

C: cathode pressing process and microwave sintering: using molds to press the decomposed powder under a certain pressure of 0.8-1.2 t/$cm^2$, putting green bodies in auxiliary heating and insulation combining device, then putting them in microwave cavity, turning on the microwave source, raising the temperature to 800-850° C. with a constant rate, then raising the temperature to 1400-1500° C. with 10~15° C./min, insulate 10-30 min, and cooling to room temperature.

In step A, the proportion of an amount of ammonium metatungstate hydrate and scandium nitrate based on the manufactured scandia-doped dispenser cathode material is: W (85%), $Sc_2O_3$ (5%), BaO, CaO and $Al_2O_3$ (10%), (molar ratio of Ba:Ca:Al=4:1:1).

The composition of reduced powder generated by step B is W, $Sc_2O_3$, BaO, CaO, and $Al_2O_3$.

The auxiliary heating material of auxiliary heating and insulation combining device is SiC; insulation material is Mullite Fiber.

BRIEF DESCRIPTION OF THE DRAWINGS

To describe the technique embodiments in detail, the appended drawings used in embodiments is introduced below. Apparently, appended drawings below are only a part of drawings of the present disclosure, and as for normal technician in this area, they can obtain other drawings based on this kind of appended drawings without creative labor.

DETAILED DESCRIPTION OF THE PREFERRED EMBODIMENTS

Figure 1:
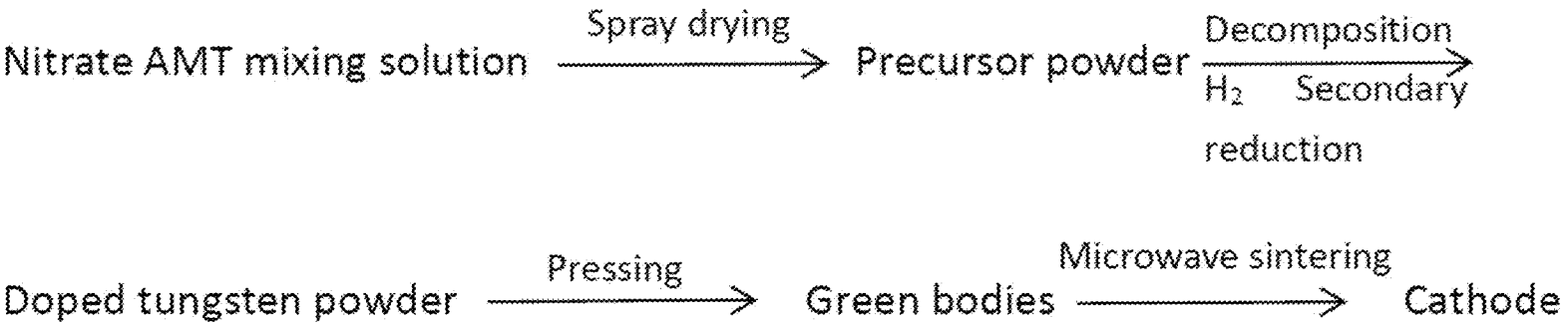
FIG. 1 is a flow chart of the preparation method of the present disclosure.
Figure 2:
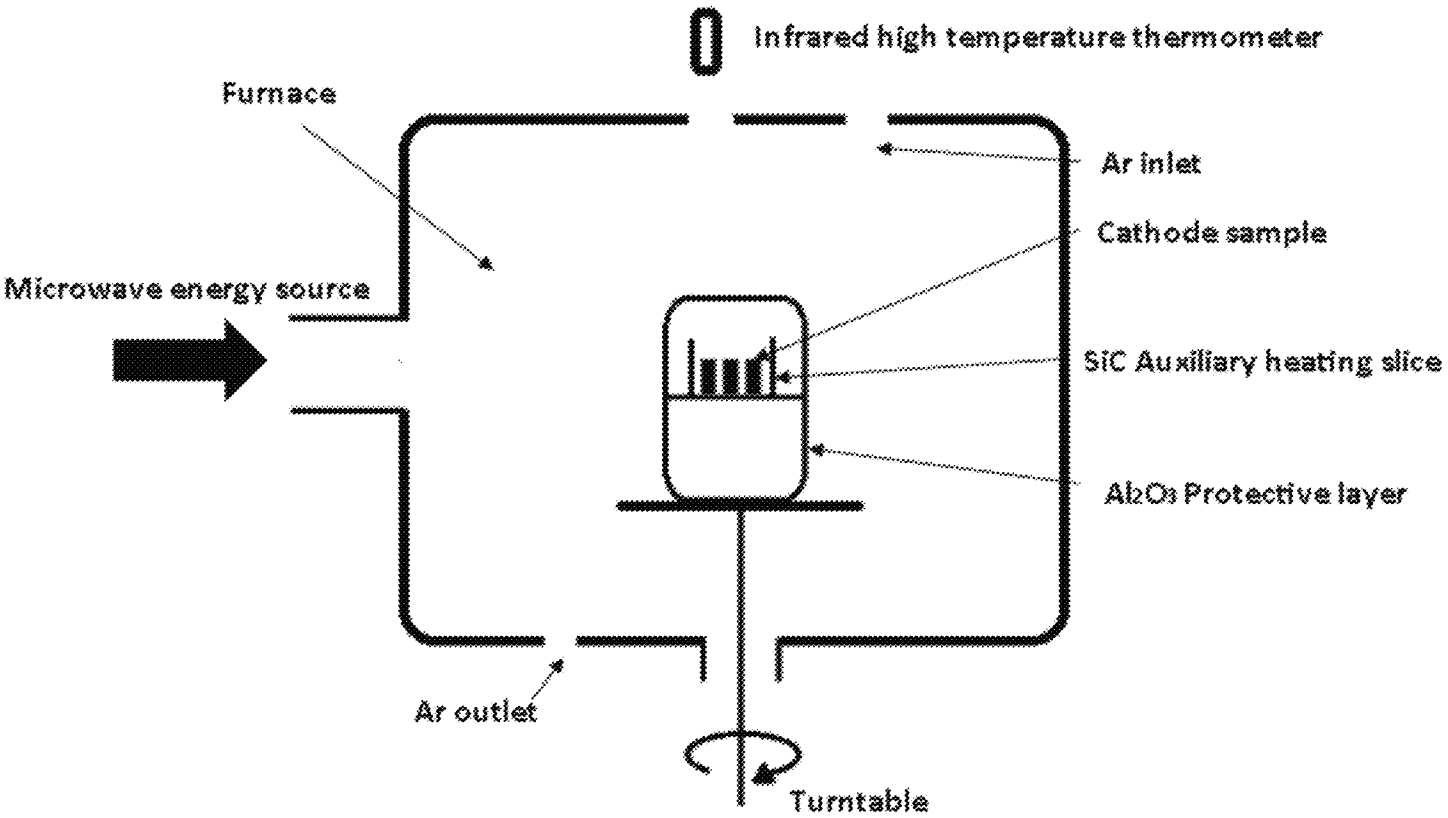
FIG. 2 is a schematic diagram of microwave sintering device.
Figure 3:
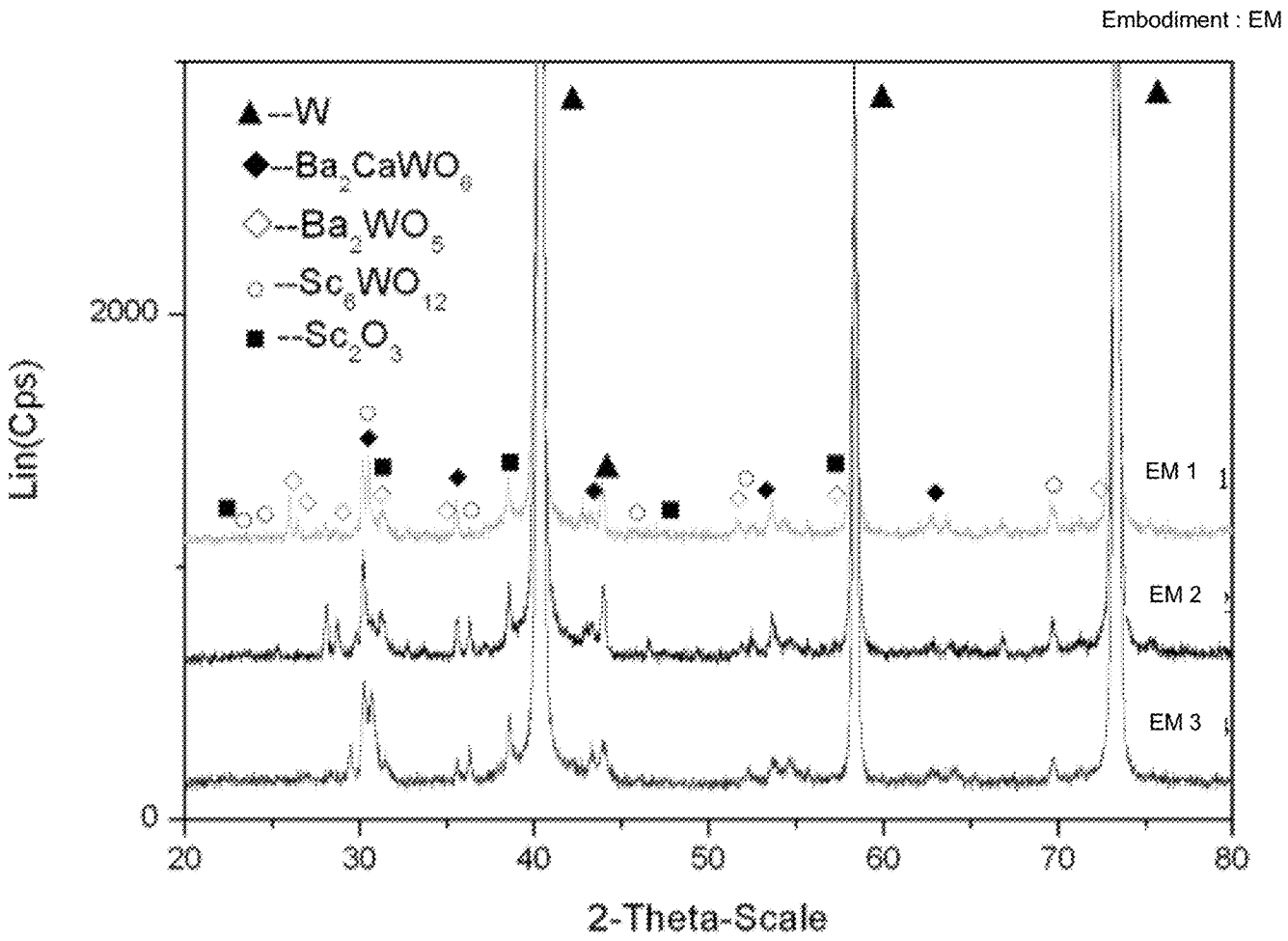
FIG. 3 is XRD results of powders after reduction.
Figure 4:
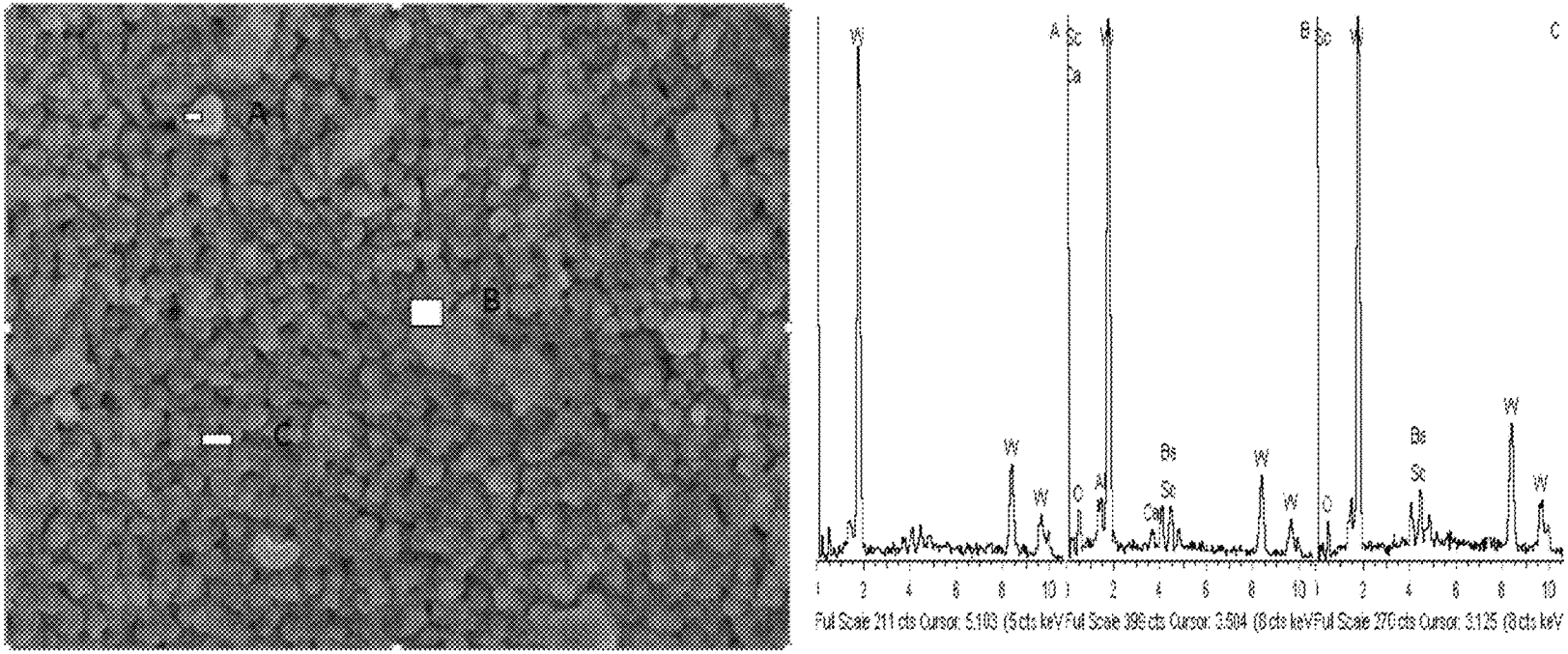
FIG. 4 shows SEM photo and EDAX energy spectrum analysis of the present disclosure.
Figure 5:
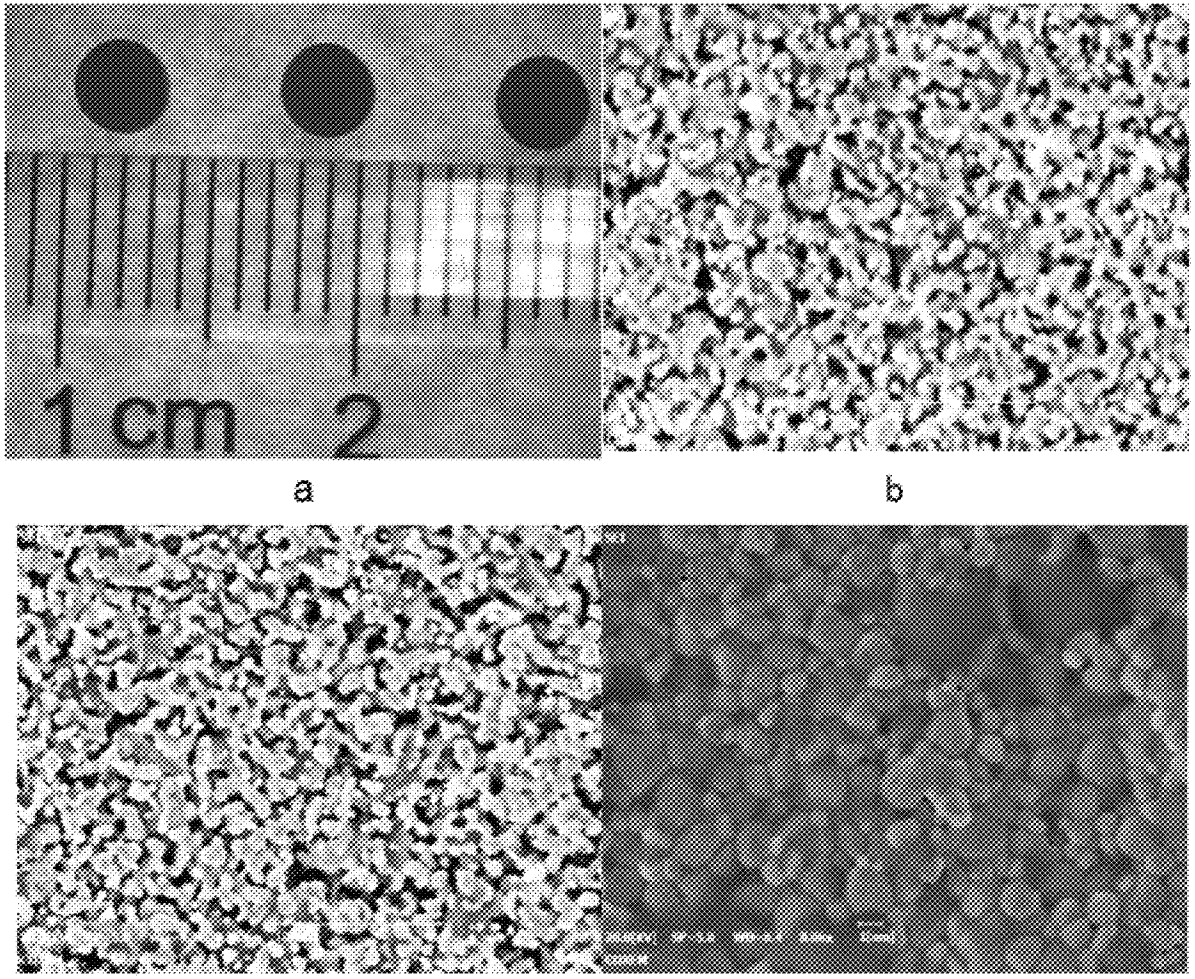
FIG. 5 shows cathode real photo and SEM photo of the present disclosure (a: cathode real photo, b: SEM photo of cathode surface of embodiments 1, c: SEM photo of cathode surface of embodiments 2, d: SEM photo of cathode surface of embodiments 3).
Figure 6:
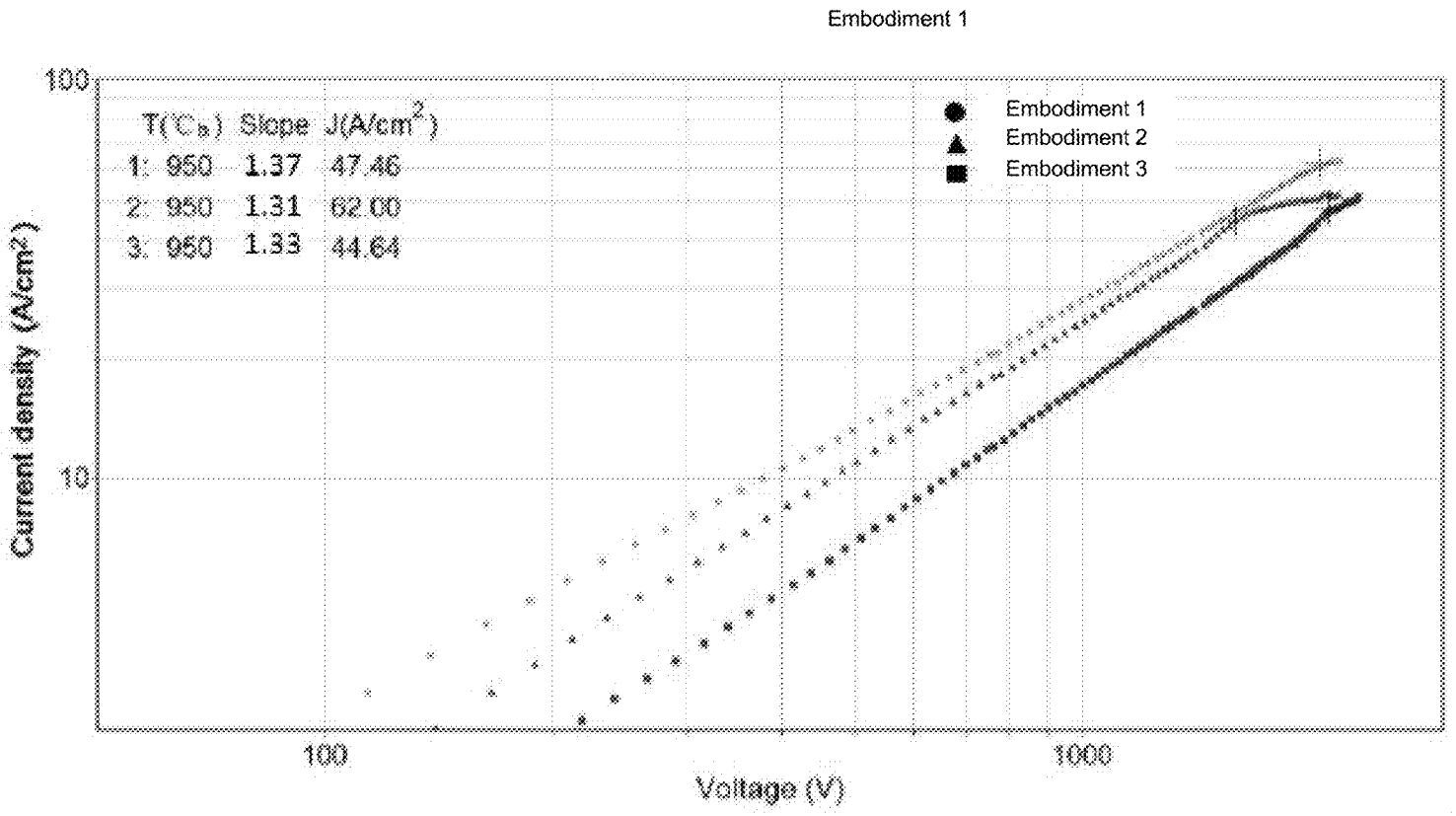
FIG. 6 is a cathode thermal emission curve (Log U-Log I) of three embodiments of the present disclosure.

The present disclosure will be described in more detail.

Embodiment 1

Dissolving barium nitrate (20.34 g), calcium nitrate tetrahydrate (4.60 g), aluminum nitrate nonahydrate (14.61 g), nitrate hexahydrate scandium (36.84 g) and ammonium metatungstate (160.668 g) in deionized water respectively, stirring until they are fully dissolved. Then preparing "411" solution, which includes barium nitrate, calcium nitrate and aluminum nitrate. Mix nitrate scandium solution and ammonium metatungstate solution, adding "411" solution slowly with constantly agitation to realize intensive mixing. Precursor powder is obtained by spray-drying, feeding rate is 600 ml/l, blast rate is 0.4 $m^3$/min-0.6 $m^3$/min, the inlet temperature is 150° C., the outlet temperature is 90-96° C. The precursor powder is decomposed in muffle furnace, C and N contains in precursor powder is removed under the conditions of 550° C., air atmosphere (or oxygen atmosphere) and maintain 3 hours, oxide powder contains scandium oxide, and tungsten oxide is obtained; proceeding reduction process of the oxide powder in tube furnace under hydrogen atmosphere, which includes two steps, first, maintaining the temperature at 500° C. maintain 2-3 h, then, raising the temperature to 900° C. and maintain 2-3 h to obtain, doped tungsten powder. At last, using molds to press the decomposed powder under pressure of 1.2 t/$cm^2$, putting green bodies in auxiliary heating and insulation combining device, then putting them in microwave cavity, turning on the microwave source, raising the temperature to 850° C. with a constant rate of 20° C./min, then raising the temperature to 1500° C. with a constant rate of 13° C./min, maintaining the temperature for 20 min, and cooling to room temperature.

Embodiment 2

Dissolving barium nitrate (6.78 g), calcium nitrate tetrahydrate (1.53 g), aluminum nitrate nonahydrate (4.78 g), nitrate hexahydrate scandium (12.28 g) and ammonium metatungstate (56.61 g) in deionized water respectively, stirring until they are fully dissolved. Then preparing "411" solution, which includes barium nitrate, calcium nitrate and aluminum nitrate. Mixing nitrate scandium solution and ammonium metatungstate solution, and adding "411" solution slowly with constantly agitation to realize intensive mixing. Precursor powder is obtained by spray-drying, feeding rate is 600 ml/l, blast rate is 0.4 $m^3$/min-0.6 $m^3$/min, the inlet temperature is: 150° C., the outlet temperature is 90-96° C. The precursor powder is decomposed in muffle furnace, C and N contains in precursor powder is removed under the conditions of 550° C., air atmosphere (or oxygen atmosphere) and maintaining 3 hours, oxide powder contains scandium oxide, and tungsten oxide is obtained; proceeding reduction process of the oxide powder in tube furnace under hydrogen atmosphere, includes two steps, first, maintaining the temperature at 500° C. with 2-3 h, then, raising the temperature to 900° C. and maintain 2-3 h to obtain doped tungsten powder. At last, using molds to press the decomposed powder under pressure of 1.2 t/$cm^2$, putting green bodies in auxiliary heating and insulation combining device, then putting them in microwave cavity, turning on the microwave source, raising the temperature to 850° C. with a constant rate of 20° C./min, then raising the temperature to 1500° C. with a constant rate of 15° C./min, maintaining the temperature for 15 min, and cooling to room temperature.

Embodiment 3

Dissolving barium nitrate (20.34 g), calcium nitrate tetrahydrate (4.60 g), aluminum nitrate nonahydrate (14.61 g), nitrate hexahydrate scandium (36.84 g) and ammonium metatungstate (160.668 g) in deionized water respectively, stirring until they are fully dissolved. Then prepare "411" solution, which includes barium nitrate, calcium nitrate and aluminum nitrate. Mixing nitrate scandium solution and ammonium metatungstate solution, add "411" solution slowly with constantly agitation to realize intensive mixing. Precursor powder is obtained by spray-drying, feeding rate is 300 ml/l, blast rate is 0.4 $m^3$/min-0.6 $m^3$/min, the inlet temperature is: 150° C., the outlet temperature is 90-96° C. The precursor powder is decomposed in muffle furnace, C and N contains in precursor powder is removed under the conditions of 550° C., air atmosphere (or oxygen atmosphere) and maintain 3 hours, oxide powder contains scandium oxide, and tungsten oxide is obtained; proceeding reduction process of the oxide powder in tube furnace under hydrogen atmosphere, includes two steps, first, maintaining the temperature at 500° C. with 2 h, then, raising the temperature to 900° C. and maintain 2 h to obtain doped tungsten powder. At last, using molds to press the decomposed powder under pressure of 1.2 t/$cm^2$, putting green bodies in auxiliary heating and insulation combining device, then putting them in microwave cavity, turn on the microwave source, raising the temperature to 800-850° C. with a constant rate of 20° C./min, then raising the temperature to 1550° C. with a constant rate of 15° C./min, maintaining the temperature for 30 min, and cooling to room temperature.

The embodiments mentioned above just are a further description of the present disclosure, but the present disclosure is more illustrative than that. Any modifications, similar substitutions, and improvements based on the present disclosure should be included in the protective range of the present disclosure.

What is claimed is:

1. A method of preparing a pressed scandia-doped dispenser cathode using microwave sintering, the method comprising:

preparing precursor powders by:

dissolving ammonium metatungstate hydrate, scandium nitrate, aluminum nitrate, barium nitrate and calcium nitrate in water under a room temperature to obtain solutions, respectively;

mixing a solution of the ammonium metatungstate hydrate and a solution of the scandium nitrate to obtain a mixture;

mixing a solution of the barium nitrate, a solution of the calcium nitrate, and a solution of the aluminum nitrate to obtain a nitrate solution;

adding the nitrate solution, while performing constant agitation, to the mixture; and obtaining precursor powder by spray drying, wherein a feeding rate is 200 ml/h-600 ml/h, a blast rate is 0.4 $m^3$/min-0.6 $m^3$/min, an inlet temperature is 150° C., and an outlet temperature is 90-96° C.;

performing decomposition and reduction of the precursor powder by:

decomposing the precursor powder in a muffle furnace for 3 hours to remove powder containing C and N in the precursor powder under a condition including a temperature of 550° C. and air or oxygen atmosphere to obtain oxide powder; and performing a reduction process of the oxide powder in a tube or furnace under hydrogen atmosphere by:

keeping the temperature at 450-550° C. and maintaining it for 2-3 h; and raising the temperature to 800-850° C. and maintaining it for 2-3 h to obtain doped tungsten powder; and pressing and sintering a cathode by:

pressing the decomposed powder under a certain pressure using molds;

placing green bodies in an auxiliary heating and insulation combining device;

placing the auxiliary heating and insulation combining device in a microwave cavity of a microwave source;

turning on the microwave source and raising the temperature in the microwave cavity with a constant rate until 800-850° C.;

maintaining the temperature for 5 minutes;

raising the temperature with a rate of 10~15° C./min until 1400-1500° C.;

maintaining the temperature for 10-30 min; and obtaining the cathode after cooling the cathode to the room temperature.

2. The method of claim 1, wherein the composition of the powder generated from the reduction process is W (85%); $Sc_2O_3$ (5%); BaO, CaO, and $Al_2O_3$ (10%), and a molar ratio of Ba:Ca:Al is 4:1:1.

3. The method of claim 1, wherein a composition of the powder generated from the reduction process is W, $Sc_2O_3$, BaO, CaO, and $Al_2O_3$.

4. The method of claim 1, further comprising:

filtering the powder through a 200-mesh screen after the preparing of the precursor powders and the performing of the decomposition and reduction of the precursor powder, respectively.

5. The method of claim 1, wherein a pressing pressure in the pressing and sintering of the cathode is 0.8-1.2 t/$cm^2$.

6. The method of claim 1, wherein an auxiliary heating material of the auxiliary heating and insulation combining device is SiC, and an insulation material of the insulation combining device is Mullite Fiber.

* * * * *